US009086220B2

(12) United States Patent
Husted et al.

(10) Patent No.: US 9,086,220 B2
(45) Date of Patent: Jul. 21, 2015

(54) ETHANOL-BURNING HEARTH APPARATUS

(75) Inventors: Martin D. Husted, Glendora, CA (US); Mark W. Klein, San Clemente, CA (US)

(73) Assignee: IHP Operations, LLC, Nashville, TN (US)

( * ) Notice: Subject to any disclaimer, the term of this patent is extended or adjusted under 35 U.S.C. 154(b) by 1050 days.

(21) Appl. No.: 12/248,443

(22) Filed: Oct. 9, 2008
(Under 37 CFR 1.47)

(65) Prior Publication Data

US 2009/0241936 A1 Oct. 1, 2009

Related U.S. Application Data

(60) Provisional application No. 61/037,699, filed on Mar. 18, 2008, provisional application No. 60/979,322, filed on Oct. 11, 2007.

(51) Int. Cl.

| | |
|---|---|
| ***F24C 5/00*** | (2006.01) |
| ***F24B 1/18*** | (2006.01) |
| ***F24C 5/14*** | (2006.01) |
| ***F24C 5/18*** | (2006.01) |

(52) U.S. Cl.
CPC ..... *F24B 1/1808* (2013.01); *F24C 5/14* (2013.01); *F24C 5/18* (2013.01)

(58) Field of Classification Search
CPC ..... F24C 5/00; F24Q 2/32
USPC ..... 126/500, 512, 43, 544, 92 R; 431/125, 431/344
See application file for complete search history.

(56) References Cited

U.S. PATENT DOCUMENTS

| | | | | |
|---|---|---|---|---|
| 125,096 | A * | 3/1872 | Levi Stevens | 441/14 |
| 3,096,754 | A * | 7/1963 | Howrey | 126/503 |
| 4,582,478 | A * | 4/1986 | Hilker | 431/125 |
| 4,637,372 | A | 1/1987 | Mogol et al. | |
| 5,328,353 | A * | 7/1994 | Keenan | 431/2 |
| 5,421,321 | A * | 6/1995 | Ward | 126/519 |
| 5,794,610 | A * | 8/1998 | Facchina | 126/512 |
| 6,267,113 | B1 * | 7/2001 | Maust et al. | 126/512 |

(Continued)

OTHER PUBLICATIONS

International Preliminary Report on Patentability dated Apr. 13, 2010 and Written Opinion dated Jan. 2, 2009 regarding PCT/US2008/079346.

(Continued)

*Primary Examiner* — Gregory Huson
*Assistant Examiner* — Nikhil Mashruwala
(74) *Attorney, Agent, or Firm* — Arent Fox LLP

(57) ABSTRACT

An apparatus having a substantially air-sealed, transparent, front through which a flame within the firebox may be viewed. The apparatus may include a burner configured to hold and burn a liquid fuel and positioned so as to cause a flame from the burning fuel to appear within the firebox. The liquid fuel may be ethanol. The apparatus may include an igniter that has a user-operated igniter control that may be operated by a user from outside of the firebox that, upon operation, causes the liquid fuel within the burner to be ignited. The apparatus may include an extinguisher that has a user-operated extinguisher control that may be operated by a user from outside of the firebox that, upon operation, causes the flame to be extinguished. The apparatus may include a fuel inlet located outside of the firebox, and a fuel channel between the fuel inlet and the burner. A fuel tank may also be provided.

33 Claims, 12 Drawing Sheets

(56) References Cited

U.S. PATENT DOCUMENTS

| | | | | |
|---|---|---|---|---|
| 6,736,132 | B2 | 5/2004 | Schlosser et al. | |
| 7,263,991 | B2 * | 9/2007 | Schlosser et al. | 126/512 |
| 7,287,979 | B2 * | 10/2007 | Backes et al. | 431/344 |
| 7,458,808 | B2 * | 12/2008 | McCarren | 431/125 |
| 8,334,471 | B2 * | 12/2012 | Zhao et al. | 200/314 |
| 2003/0188735 | A1 * | 10/2003 | Yang | 126/519 |
| 2004/0149279 | A1 * | 8/2004 | Erickson | 126/512 |
| 2005/0103324 | A1 | 5/2005 | Lyons et al. | |
| 2005/0178379 | A1 * | 8/2005 | Weinberger | 126/500 |
| 2005/0227194 | A1 * | 10/2005 | Weinberger | 431/331 |
| 2006/0134575 | A1 * | 6/2006 | Backes et al. | 431/344 |
| 2007/0224560 | A1 * | 9/2007 | Stainrod et al. | 431/125 |
| 2008/0216819 | A1 * | 9/2008 | Backes | 126/500 |
| 2012/0037141 | A1 * | 2/2012 | Jensen | 126/93 |
| 2012/0282559 | A1 * | 11/2012 | Barudi et al. | 431/12 |

OTHER PUBLICATIONS

Publication No. WO2009049047A1 dated Apr. 16, 2009 and International Search Report dated Jan. 2, 2009 regarding PCT/US2008/079346.

* cited by examiner

FIG. 3
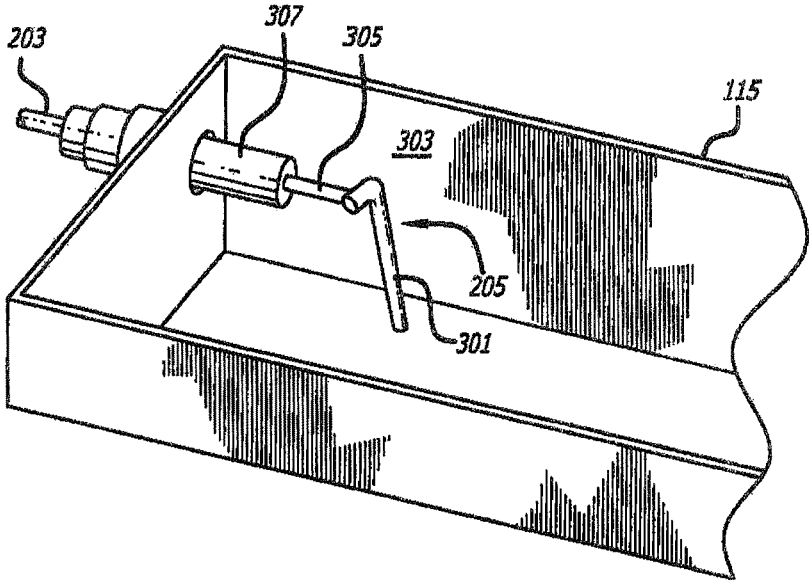
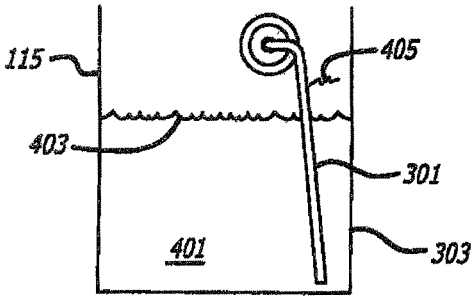
FIG. 4A
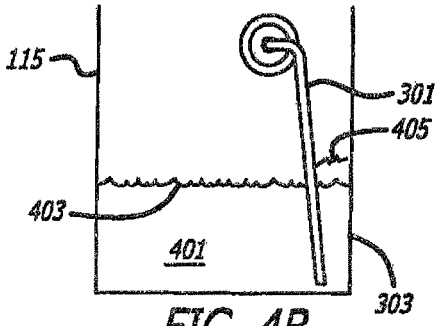
FIG. 4B
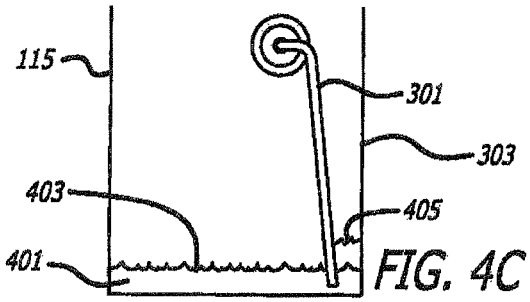
FIG. 4C

ETHANOL-BURNING HEARTH APPARATUS

CROSS-REFERENCE TO RELATED APPLICATION

This application claims benefit under 35 U.S.C. §119 to U.S. Provisional Application No. 60/979,322, filed Oct. 11, 2007, entitled SEALED, DIRECT VENT ETHANOL-BURNING FIREPLACE, and U.S. Provisional Application No. 61/037,699, filed Mar. 18, 2008, entitled ETHANOL-BURNING HEARTH APPARATUS. The disclosures of the prior applications are hereby incorporated by reference in their entirety.

BACKGROUND

1. Field

This disclosure relates to hearth products, and more specifically, to ethanol-burning hearth products.

2. Description of Related Art

Hearth products, such as fireplaces, fireplace inserts, log sets, stoves, heaters, furnaces, outdoor fire products, water heating products, barbeque and grilling products, and the like, are commonly fueled by wood or coal products. However, regulations may limit the use of these fuels.

Natural and propane gas have also been used. However, these may require a gas supply line and, in some case, a power source to operate the product.

Ethanol products, in the form of a gel-based mixture packaged in a small metal container, have been developed for a homeowner to burn within a hearth product, without having to install natural or propane gas lines. When certified, however, these ethanol products are described as candles and are classified under certification standards such as self-contained candle products. This eliminates the need to test and certify their combustion properties. However, they may not be classified for use with vent-free hearth devices or sealed combustion products, such as a direct vent or B vented fireplace or stove. Further, these ethanol products usually burn for only a short time and may not provide an adequate flame pattern. These hearth products have also traditionally required manual lighting and shutoff which has made them unsuitable for use in sealed combustion products.

Fuels for gel-based products may be provided in small cans. They must also be disposed after use, and may leave a residue from incomplete combustion. These gel-based products may also produce an undesirable amount of soot and carbon monoxide. The costs of the small cans can also be very expensive, compared to natural gas or propane.

Liquid ethanol has also been used in hearth products. However, it can present significant challenges. For example, the hearth product may not generate a wood-burning-like yellow, dancing flame. The hearth product may also be difficult to ignite without also getting ethanol on the igniter, thus causing the igniter to also catch fire. It may also be difficult to add more ethanol while a flame is burning, so as to avoid the flame going out prematurely. It may also be difficult to extinguish a flame before the fuel is spent. These problems, as well as others, have heretofore made it impractical to use ethanol in hearth products.

SUMMARY

In one aspect of the disclosure an apparatus includes a sealed, vented firebox having a substantially air-sealed, transparent, front through which a flame within the firebox may be viewed, and a burner configured to hold and burn a liquid fuel and positioned so as to cause a flame from the burning fuel to appear within the firebox. A "vented" firebox includes a direct vent firebox, a B vented firebox, or any other suitable vented firebox.

In another aspect of the disclosure, an apparatus includes a firebox, a burner configured to hold and burn liquid ethanol and positioned so as to cause a flame from the burning fuel to appear within the firebox, an igniter that has a user-operated igniter control that may be operated by a user from outside of the firebox that, upon operation, causes liquid ethanol within the burner to be ignited, and an extinguisher that has a user-operated extinguisher control that may be operated by a user from outside of the firebox that, upon operation, causes the flame to be extinguished.

In a further aspect of the disclosure, an apparatus includes a firebox, a burner configured to hold and burn liquid ethanol and positioned so as to cause a flame from the burning fuel to appear within the firebox, an ethanol fuel inlet located outside of the firebox, and a fuel channel between the ethanol fuel inlet and the burner.

It is understood that other aspects of the invention will become readily apparent to those skilled in the art from the following detailed description, wherein various aspects of the invention are shown and described by way of illustration. As will be realized, the invention is capable of other and different configurations and implementations and its several details are capable of modification in various other respects, all without departing from the scope of this invention. Accordingly, the drawings and detailed description are to be regarded as illustrative in nature and not as restrictive.

BRIEF DESCRIPTION OF DRAWINGS

The drawings disclose illustrative embodiments. They do not set forth all embodiments. Other embodiments may be used in addition or instead. Details that may be apparent or unnecessary may be omitted to save space or for more effective illustration. When the same numeral appears in different drawings, it is intended to refer to the same or like components or steps.

FIG. 3 illustrates a fixed-position spark gap within the burner illustrated in FIG. 1.

FIGS. 4(*a*)-(*c*) are profile views of the spark gap illustrated in FIG. 3 operating with different levels of liquid fuel in the burner.

FIG. 7(*b*) illustrates a burner that may produce a substantially yellow dancing flame that may not move downwardly along with the level of the liquid fuel as it is depleted.

FIG. 8(*b*) illustrates a profile of the burner illustrated in FIG. 7(*b*) after the liquid fuel has been burning for a short while.

FIG. 8(*c*) illustrates a profile of the burner illustrated in FIG. 7(*c*) after the liquid fuel has been burning for a long time.

DETAILED DESCRIPTION OF ILLUSTRATIVE EMBODIMENTS

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

In the following detailed description, various concepts will be described in the context of a sealed, direct vent fireplace. While these concepts are well suited for this application, those skilled in the art will readily appreciate that these concepts are likewise applicable to other hearth products, including by way of example, and without limitation, B vented and vent-free fireplaces, as well as fireplace inserts, log sets, stoves, heaters, furnaces, outdoor fire products, water heating products, barbeque and grilling products, and the like, whether vented (e.g., direct vent or B vented) or vent-free. Accordingly, any reference to a sealed, direct vent fireplace is intended only to illustrate these concepts, with the understanding the such concepts have a wide range of applications.

They may also be adapted to outdoor fire products, water heating products, and/or barbecue and grilling products. They may also be adapted to inserts for existing wood burning fireplaces.

Figure 1:
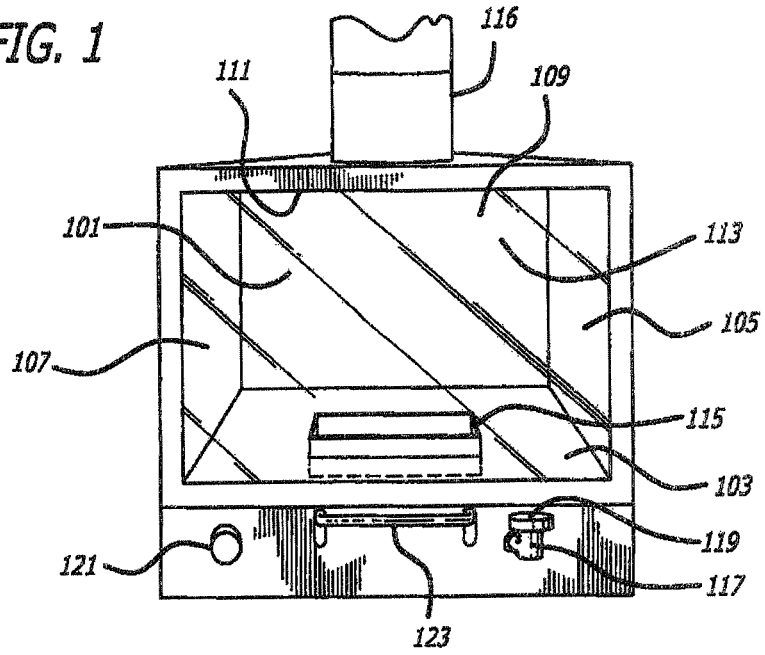
FIG. 1 illustrates a sealed, directly vented fireplace.

FIG. 1 illustrates a sealed, directly-vented fireplace. As shown in FIG. 1, a firebox 101 may include a floor 103, a side wall 105, a side wall 107, a rear wall 109, and a ceiling 111. The floor 103, side walls 105 and 107, rear wall 109, and ceiling 111 may cooperate to create a front through which a flame within the firebox may be viewed.

The floor 103, side walls 105 and 107, rear wall 109, and ceiling 111 may be made of any material, such as material that does not readily melt or burn. For example, the floor 103, side walls 105 and 107, rear wall 109, and/or ceiling 111 may be made of metal, cement panels or masonry products or any combination of these.

The front of the firebox 101 may be covered with a transparent plate, such as glass plate 113 or screen mesh. A double wall pipe system 116 may be used to pull outside air into the firebox 101 for combustion and to exhaust flue gas back to the outside. Except for the double wall pipe system 116, the firebox 101 may be substantially air-sealed by virtue of substantially air-tight fittings between the components of the enclosure that defines the firebox 101, namely the floor 103, the side walls 105 and 107, the rear wall 109, the ceiling 111, and the glass plate 113.

A burner 115 may be configured to hold and burn a liquid fuel, such as ethanol. The burner 115 may be positioned with respect to the firebox 101 so that a flame from liquid fuel that is burning within the burner 115 appears within the firebox 101. A portion of the burner 115 may be beneath the floor 103, while another portion of the burner 115 may be above the floor 103. In other embodiments, all portions of the burner 115 may be beneath or above the floor 103. The burner 115 may be made of any material, such as material that does not readily burn or melt, such as steel, ceramic, glass or high temperature thermoplastic.

The fireplace may include a fuel inlet 117 covered by a fuel cap 119. After removal of the fuel cap 119, liquid fuel, such as ethanol, may be poured into the fuel inlet 117, causing the burner 115 to fill with the liquid fuel that is supplied. A fuel tank (not shown in FIG. 1) may be positioned between the fuel inlet 117 and the burner 115 to function as a reservoir for fuel, as will be explained in more detail below in connection with the discussion of FIGS. 14-17.

The fireplace may include a user-operated igniter control 121. This control may be located or otherwise configured so that it may operated by a user from outside of the firebox. In cooperation with other components of an igniter, operation of the user-operated igniter control 121 may cause liquid fuel within the burner 115 to ignite. More details about various igniters are provided below in connection with the discussion of FIGS. 2-6.

The fireplace may include a user-operated extinguisher control 123. This control may be located or otherwise configured so that it may be operated by a user from outside of the firebox. In cooperation with other components of an extinguisher, operation of the user-operated extinguisher control 123 may cause a flame that may be burning within the burner 115 to be extinguished. More details about various extinguisher are provided below in connection with the discussion of FIGS. 10-13.

Figure 2:
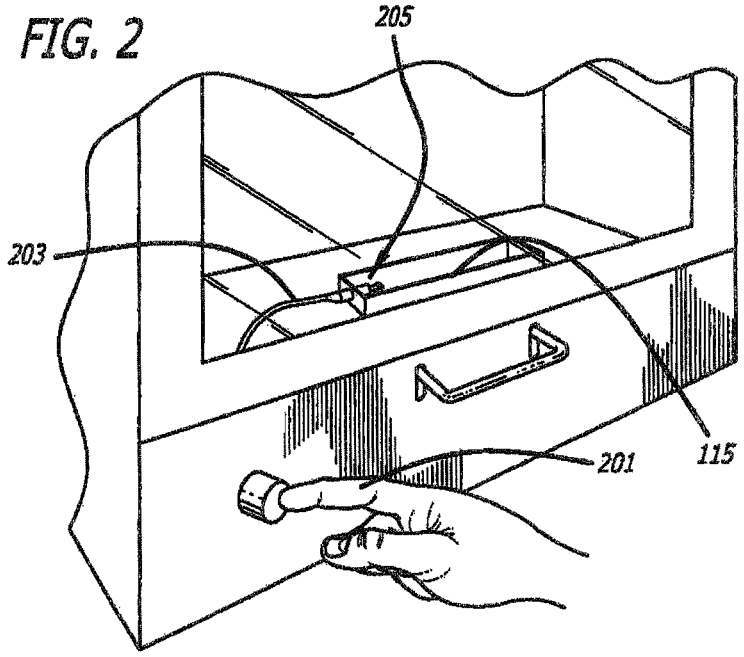
FIG. 2 illustrates a user operating the user-operated igniter control illustrated in FIG. 1 from outside of the firebox.

FIG. 2 illustrates a user operating the user-operated igniter control illustrated in FIG. 1 from outside of the firebox illustrated in FIG. 1. As shown in FIG. 2, a user 201 may press the user-operated igniter control 121. This may close an electrical circuit, thereby causing a high voltage to be delivered through a high voltage cable 203 to a spark gap 205 within the burner 115. In turn, this may ignite liquid fuel that is within the burner 115.

The user-operated igniter control 121 may be of any type. It may be an electrical switch that, upon actuation, closes an electrical circuit with an external source of power, such as a battery or line voltage. The user-operated igniter control 121 may instead include a magnet and electrical coil that generate electricity upon actuation. The user-operated igniter control 121 may instead be a wireless control located external to the fireplace. A transformer or inductor may in any event be used to increase the voltage.

FIG. 3 illustrates a fixed-position spark gap within the burner illustrated in FIG. 1. As shown in FIG. 3, the spark gap 205 may be formed by the spaced-apart relationship between an ignition rod 301 and a rear wall 303 of the burner 115. A high voltage may be delivered to the ignition rod 301 through a lead 305 that passes through an insulator 307 to the high voltage cable 203. The ignition rod 301 may be made of a conducting metal, such as steel or aluminum.

FIGS. 4(*a*)-(*c*) are profile views of the spark gap illustrated in FIG. 3 operating with different levels of liquid fuel in the burner. As shown in FIGS. 4(*a*)-(*c*), the ignition rod 301 may be angled with respect to the rear wall 303 of the burner 115. The angle may be such that an upper portion of the ignition rod 301 is further away from the rear wall 303 than a lower portion of the ignition rod 301. The rod may be constructed with knurls that induce wicking of the fuel to the top of the ignition rod 301. The combination of the knurls and the angle may cause a spark 405 between the ignition rod 301 and the rear wall 303 to always take place just above a surface 403 of a liquid fuel 401. As the level of liquid fuel 401 declines, the spark may continue to fire just above the surface 403 of the liquid fuel 401, thus reliably igniting the fuel, notwithstanding changes in its level.

The ignition rod 301 may be in any other shape, form or position. For example, it may include or consist of a spring coiled around ember material.

Figure 5:
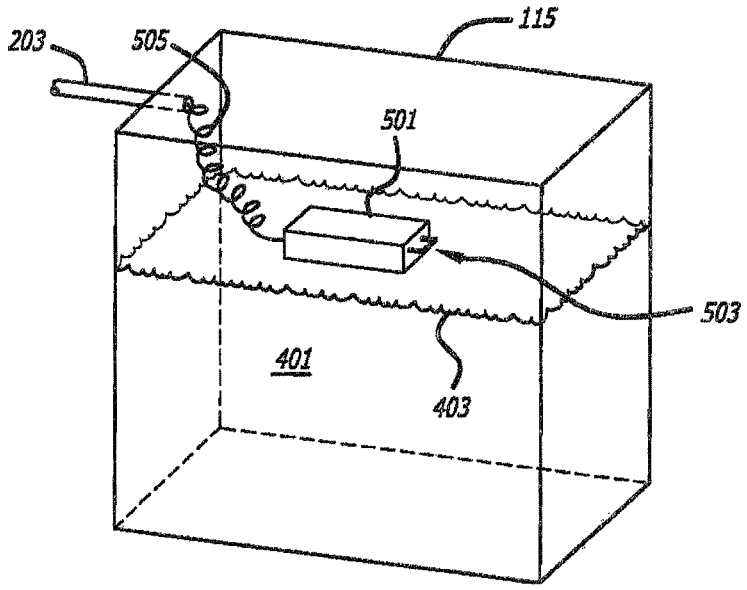
FIG. 5 illustrates a floating spark gap within the burner illustrated in FIG. 1.

FIG. 5 illustrates a floating spark gap within the burner illustrated in FIG. 1. As shown in FIG. 5, a flotation device 501 may be positioned within the burner 115 so as to float on the surface 403 of the liquid fuel 401. The flotation device 501 may have a spark gap 503 attached and configured with respect to the flotation device 501 so that the spark gap 503 is just slightly above the surface 403. The flotation device 501 may be connected to the high voltage cable 203 through a flexible coil 505, which may be configured to conduct the high voltage from the high voltage cable 203 to the spark gap 503, while freely changing length so as to allow the flotation device 501 to change level in response to changes in the level of the surface 403 of the liquid fuel 401. The flotation device 501 may be of any shape and be made of any material. It may be hollow so as to provide the needed buoyancy, or may be solid but of a density less than the density of the liquid fuel 401. The shape of the flotation device 501 may be such as to maintain the spark gap 503 in close proximity to the surface 403 of the liquid fuel 401, without touching the surface 403, notwithstanding changes in the level of the surface 403 of the liquid fuel 401 or minor instability in the surface 403.

Figure 6:
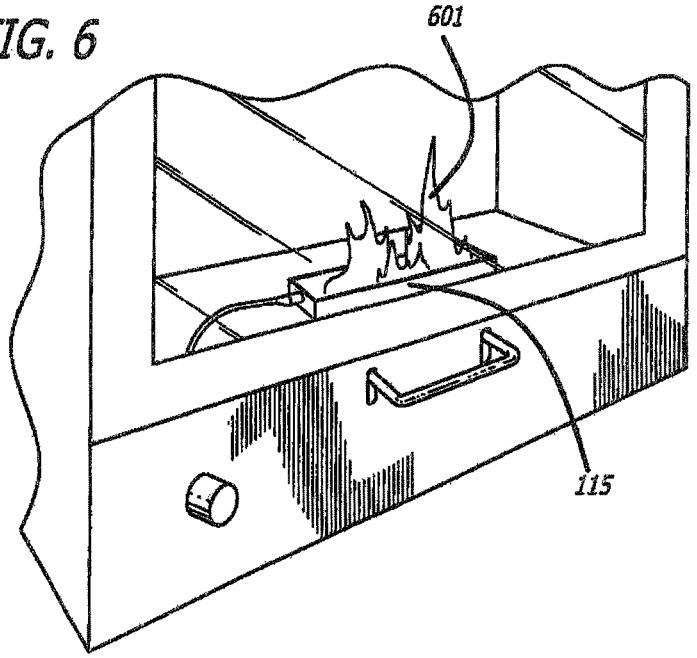
FIG. 6 illustrates a flame burning within the burner illustrated in FIG. 1 after the liquid fuel in the burner has been ignited.

FIG. 6 illustrates a flame burning within the burner illustrated in FIG. 1 after the liquid fuel in the burner has been ignited. As shown in FIG. 6, a flame 601 may rise from the opening of the burner 115. The flame 601 may be ignited by the spark gap 205 illustrated in FIG. 3 or the spark gap 503 illustrated in FIG. 5 or by any other means.

Figure 7A:
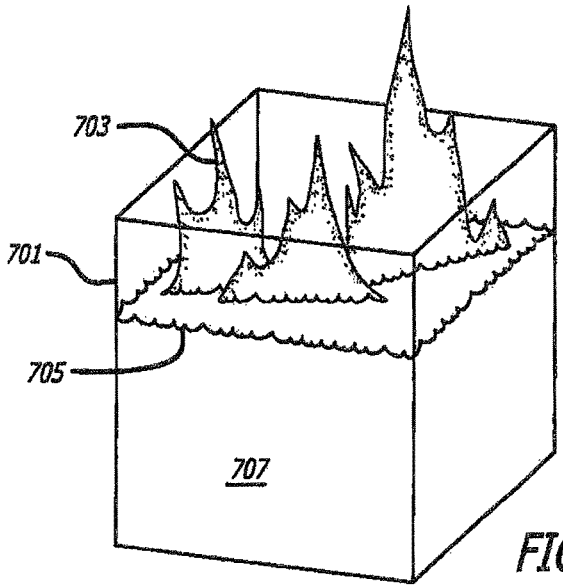
FIG. 7(*a*) illustrates a burner that may only produce a substantially blue flame that moves downwardly along with the level of the liquid fuel as it is depleted.
Figure 7B:
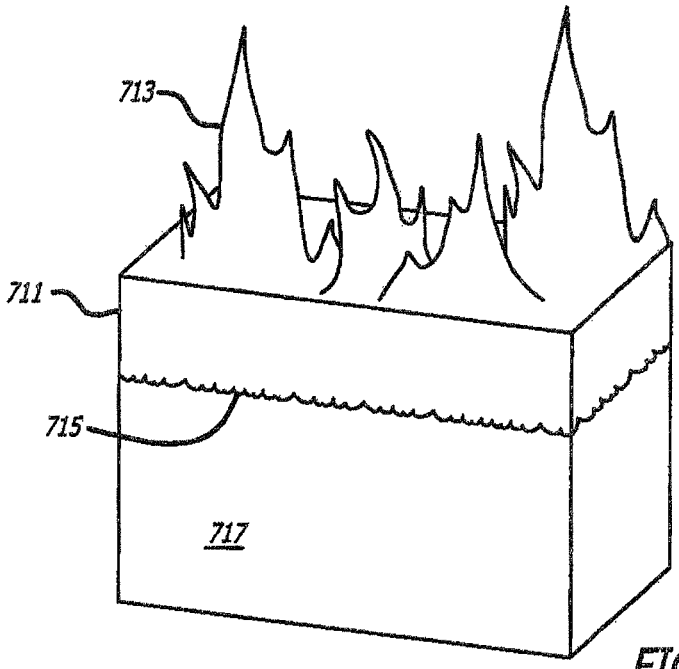

FIG. 7(*a*) illustrates a burner that may only produce a substantially blue flame that moves downwardly along with the level of the liquid fuel as it is depleted. As illustrated in FIG. 7(*a*), a burner 701 may be substantially in the shape of a cube. With this configuration, a flame 703 may begin from approximately a surface 705 of a liquid fuel 707. The flame 703 may be substantially blue and may not flutter a great deal, causing it to look much different from a wood-flame. In addition, the flame 703 may move downwardly along with the level of the liquid fuel 707 as it is depleted.

FIG. 7(*b*) illustrates a burner that may produce a substantially yellow dancing flame that may not move downwardly along with the level of the liquid fuel as it is depleted. As shown in FIG. 7(*b*), a burner 711 may be substantially rectangular and dimensioned to causes a flame 713 to begin at approximately the top of the burner 711, regardless of the level of a surface 715 of a liquid fuel 717. A more detailed explanation as to how this may occur will now be set forth in conjunction with a discussion of FIGS. 8(*a*)-(*c*).

Figure 8A:
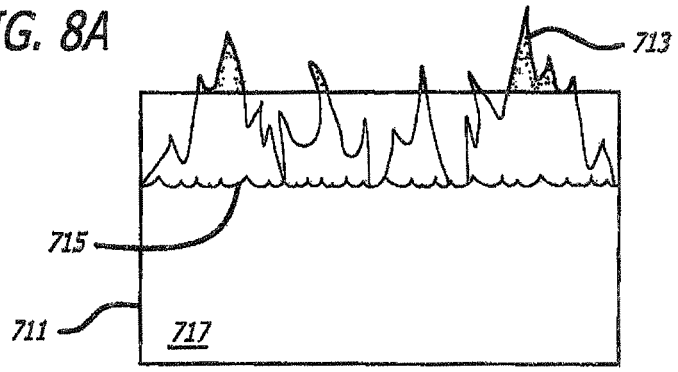
FIG. 8(*a*) illustrates a profile of the burner illustrated in FIG. 7(*b*) after the liquid fuel has just been ignited.
Figure 8B:
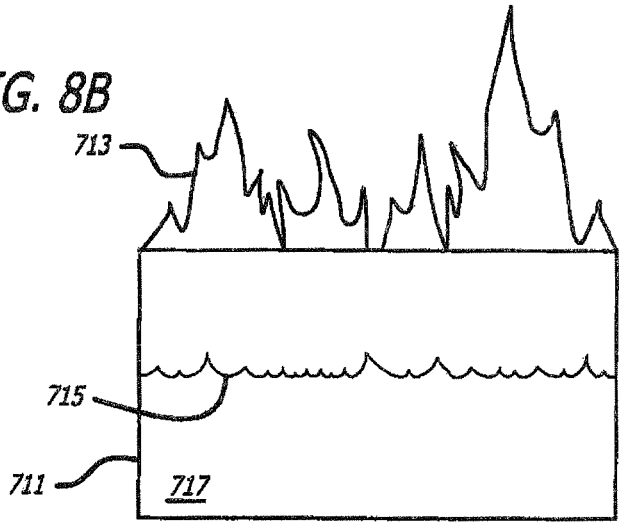
Figure 8C:
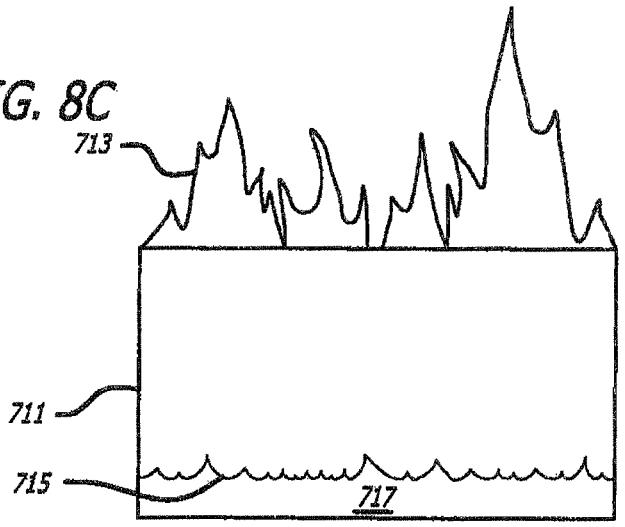

FIG. 8(*a*) illustrates a profile of the burner illustrated in FIG. 7(*b*) after the liquid fuel has just been ignited. As shown in FIG. 8(*a*), the flame 713 may begin at about the level of the surface 715 of the liquid fuel 717. At this time, the flame may be mostly pale blue and may not flicker very much, just like the flame 703 in FIG. 7(*a*).

FIG. 8(*b*) illustrates a profile of the burner illustrated in FIG. 7(*b*) after the liquid fuel has been burning for a short while, typically within a few minutes after ignition. By this time, the burner 711 and the liquid fuel 717 within it may have gotten very hot. This may cause the liquid fuel 717 to boil, preventing ignition below the source of oxygen. If the burner 711 is shaped as illustrated in FIG. 7(*b*), the flame 713 may also begin burning at approximately the top of the burner 711. With an ample supply of oxygen, the color of the flame 713 may also change to a substantially clean yellow. The turbulence from the burning liquid fuel 717 may also cause the flame 713 to flicker substantially, much like a flame from burning wood.

FIG. 8(*c*) illustrates a profile of the burner illustrated in FIG. 7(*c*) after the liquid fuel has been burning for a long time. By this time, the level of the surface 715 of the liquid fuel 717 within the burner 711 may have gotten very low. Notwithstanding, the flame 713 may continue to begin burning from the top of the burner 711, may continue to have a substantially yellow color, and may continue to flicker, again much like a flame from burning wood.

Thus, the configuration of the burner illustrated in FIG. 7(*b*), as contrasted to the configuration illustrated in FIG. 7(*a*), may cause a more natural-looking flame and may cause the vertical position of the flame 713 to be substantially independent of the level of the surface 715 of the liquid fuel 717.

Applicants have discovered the dimensional relationships that cause the flame to at as illustrated and described above in connection with FIGS. 7(*b*) and 8, as contrasted to the way it acts in FIG. 7(*a*). Applicants have discovered that the more realistic and stabilized flame of FIG. 7(*b*) may result when the height of the burner is at least 3.2 times its width. Applicants have also discovered that the more realistic and stabilized flame may also be affected by the hydraulic diameter of the burner, namely the ratio between the surface area of its upper opening and the perimeter of its upper opening 6.5 to 9.5 hydraulic diameters. Larger hydraulic diameters appear to contribute to causing the more realistic and stabilized flame.

Figure 9:
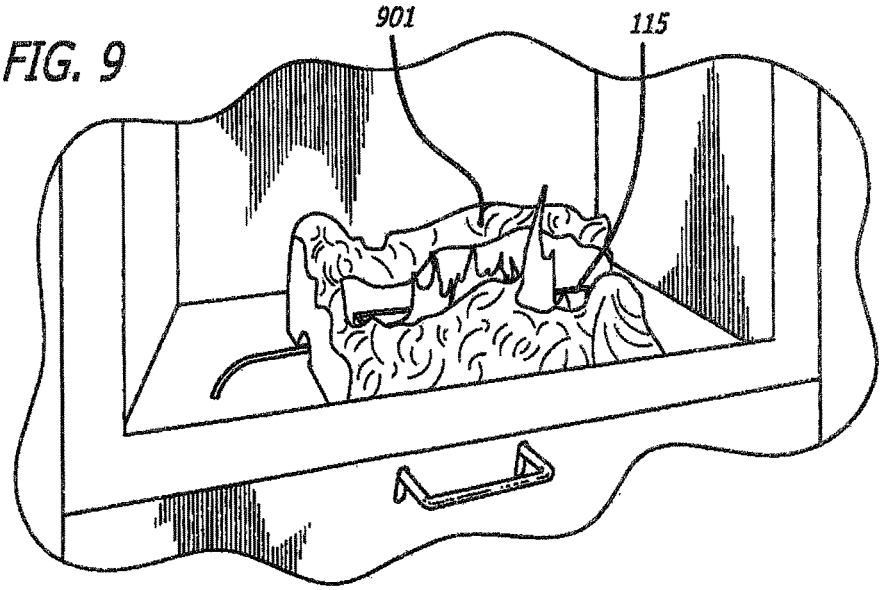
FIG. 9 illustrates a log set that may be positioned around the burner in the fireplace illustrated in FIG. 1.

FIG. 9 illustrates a log set that may be positioned around the burner in the fireplace illustrated in FIG. 1. As illustrated in FIG. 9, a log set 901 may be placed around the burner 115 illustrated in FIG. 1. The log set may be a single, unitized set of logs, or it may be several individual logs. The logs may be configured so as to cause the flame to rise between the logs, as illustrated in FIG. 9, and/or from behind the logs, and/or in front of the logs. The logs may be made of any materials such as material that does not readily burn or melt and/or that readily radiates heat. Materials that may be used include cement or ceramic composite. The size, shape, and number of logs may vary. A simulated rock bed or other decorative art may be used in addition or instead.

Figure 10:
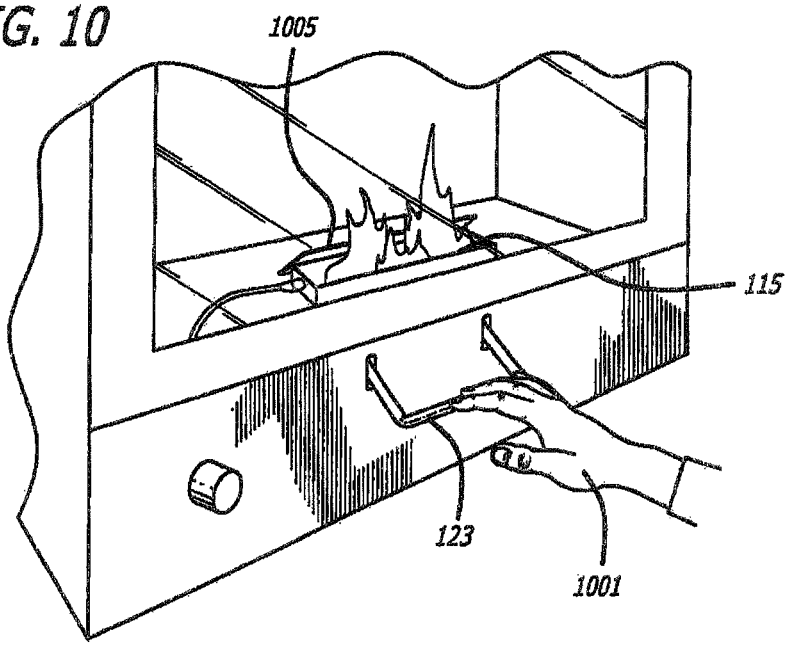
FIG. 10 illustrates a user operating the user-operated extinguisher control illustrated in FIG. 1 from outside of the firebox.

FIG. 10 illustrates a user operating the user-operated extinguisher control illustrated in FIG. 1 from outside of the firebox. As illustrated in FIG. 10, a user 1001 may push downwardly on the user-operated extinguisher control 123 while a flame 1003 is burning from within the burner 115. This may cause a lid 1005 to emerge from a recessed position behind the burner 115, as illustrated in FIG. 10. (The recessed position of the lid before the user-operated extinguisher control 123 is operated is illustrated in FIG. 12 and described below.)

As illustrated in FIG. 10, the lid 1005 may be sized and shaped so as to completely cover the top of the burner 115 upon full closure. The lid 1005 may be made of any material, such as material that does not readily burn or melt, such as steel.

Figure 11:
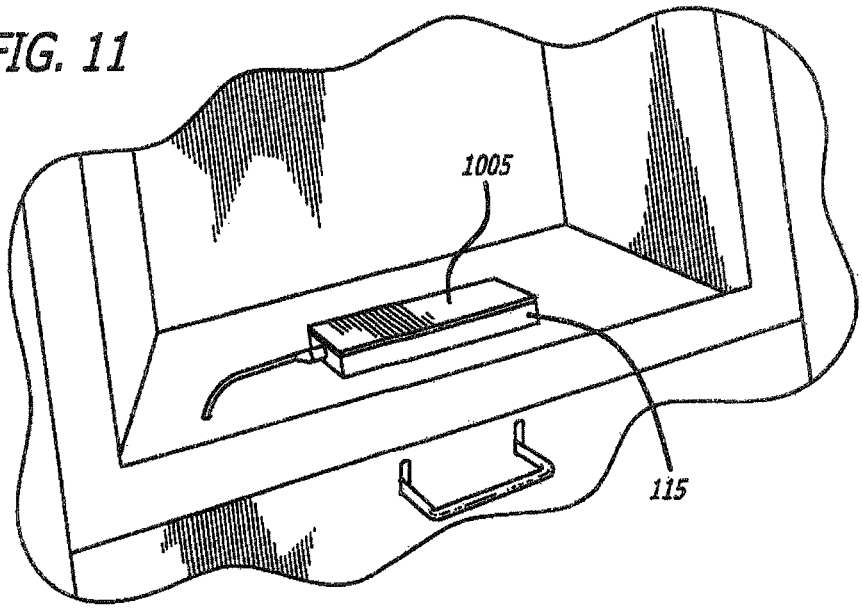
FIG. 11 illustrates the lid illustrated in FIG. 10 in a fully closed position on top of the burner.

FIG. 11 illustrates the lid illustrated in FIG. 10 in a fully closed position on top of the burner. As the user 1001 continues to push downwardly on the user-operated extinguisher control 123 from outside of the firebox, the lid 1005 may continue to close and may ultimately fully cover the burner 115, as illustrated in FIG. 11. This may cut off the oxygen supply to the liquid fuel that was burning within the burner 115, thus extinguishing the flame, as also illustrated in FIG. 11.

Figure 12:
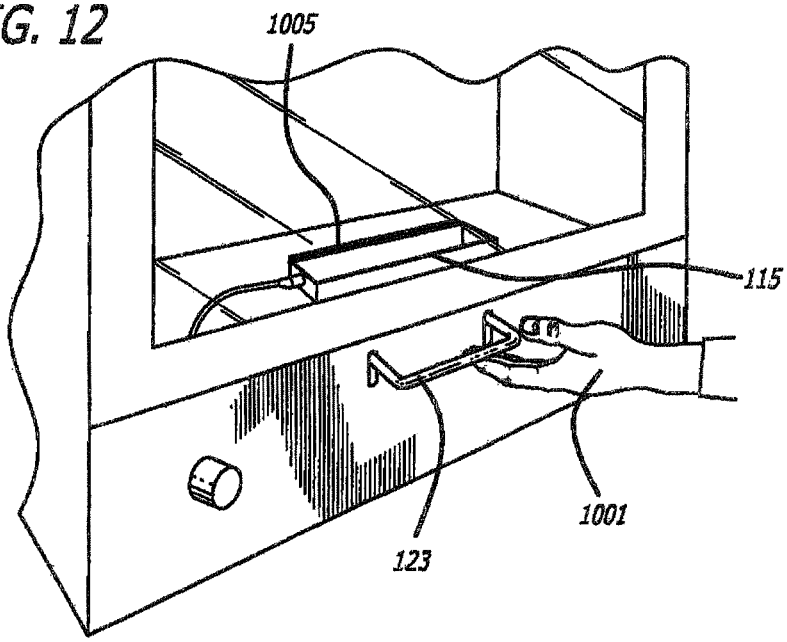
FIG. 12 illustrates a user operating the user-operated extinguisher control illustrated in FIG. 1 from outside of the firebox to re-open the burner in preparation for ignition.

FIG. 12 illustrates a user operating the user-operated extinguisher control illustrated in FIG. 1 from outside of the firebox to re-open the burner in preparation for ignition. As illustrated in FIG. 12, when the user 1001 pulls upwardly on the user-operated extinguisher control 123, the lid 1005 may be raised and retracted into the recessed position behind the burner 115. The burner 115 is now ready for the liquid fuel within it to be ignited.

Figure 13:
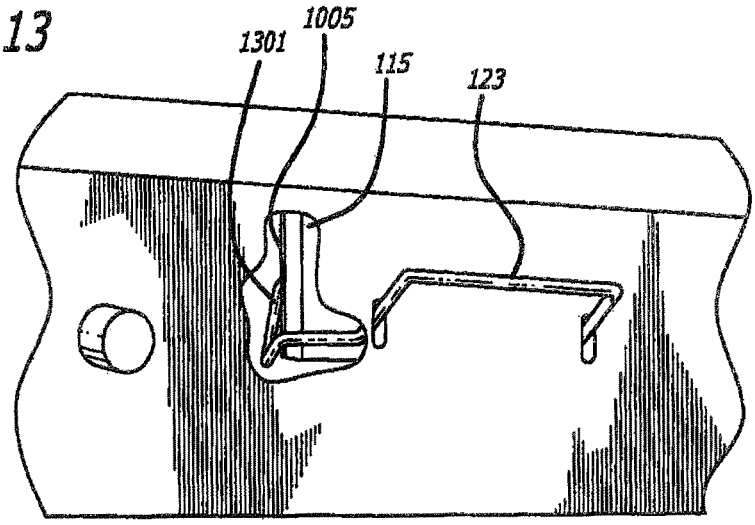
FIG. 13 illustrates linkage between the user-operated extinguisher control illustrated in FIG. 1 and the lid illustrated in FIG. 10.

FIG. 13 illustrates linkage between the user-operated extinguisher control illustrated in FIG. 1 and the lid illustrated in FIG. 10. As shown in FIG. 13, the user-operated extinguisher control 123 may be linked through linkage 1301 to the lid 1005. Any type of linkage may be used to couple the user-operated extinguisher control 123 to the lid 1005 and to thereby cause the lid 1005 to move in the manner described above in connection with FIGS. 10-12 in response to operation of the user-operated extinguisher control 123 from outside of the firebox. For example, pivots, levers, and/or other mechanisms may be used to facilitate this movement, including causing the lid 1005 to recess behind the burner 115 when it is fully opened.

Any other type of linkage or means may be used to operate the lid 1005 from outside of the firebox 101. For example, an electric solenoid or motor may be used to operate the lid after being actuated by an external switch. The switch may be outside of the firebox. It may be attached to the fireplace or may be part of a wireless control that is operated outside of the firebox. The lid may also be closed automatically in response to a heat sensor that senses the absence of a flame.

Figure 14:
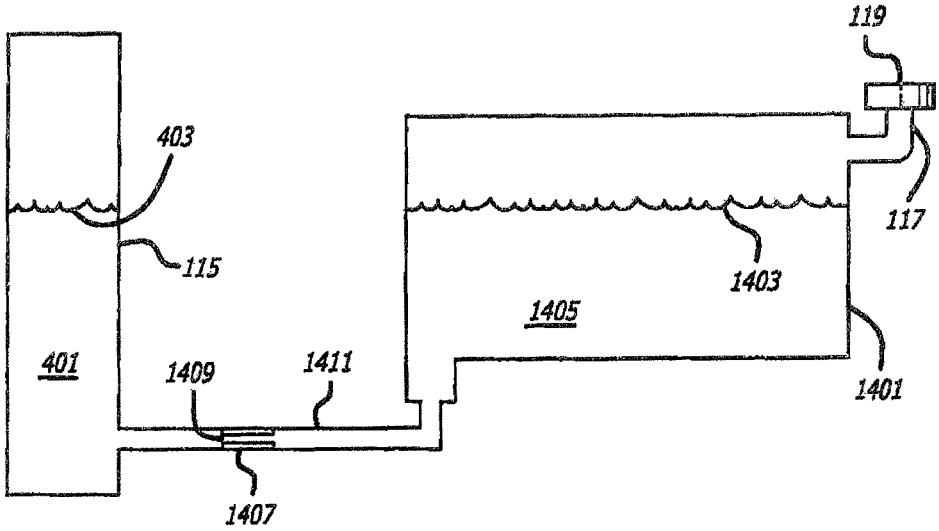
FIG. 14 illustrates a fuel tank that may be used in cooperation with the burner illustrated in FIG. 1.

FIG. 14 illustrates a fuel tank that may be used in cooperation with the burner illustrated in FIG. 1. As shown in FIG. 14, the fuel inlet 117 covered by the fuel cap 119 may lead to a fuel tank 1401 that is connected to the burner 115 through a fuel channel 1411. Liquid fuel 1405 from within the fuel tank 1401 may flow through the fuel channel 1411 into the burner 115.

The fuel tank 1401 may be of any configuration and may be made of any material, such as material that does not readily react to liquid fuel that may be placed within the tank. Examples include steel, copper, aluminum or durable plastics. The fuel tank 1401 may be configured to fit underneath the floor 103 of the firebox 101. It may be sized to hold enough liquid fuel so as to provide a desired burn time, consistent with the space that may be available under the floor 103. The fuel tank 1401 may instead be wholly or partially remote from the fireplace.

The fuel cap 119 may include a check valve that allows air to enter the fuel inlet 117 as the level of a surface 1403 of the liquid fuel 1405 within the fuel tank 1401 decreases. The check valve may also be configured not to allow fuel or fumes from within the tank to escape through the fuel cap 119.

A passageway restriction device 1407 may be placed within the fuel channel 1411. The passageway restriction device 1407 may be configured to allow fuel to flow through the fuel channel 1411 from the fuel tank 1401 to the burner 115, while blocking any flame in the burner 115 from flashing back through the fuel channel 1411 to the fuel tank 1401 when the fuel in the burner 115 is exhausted. The passageway restriction device 1407 may include an interior channel 1409 that is large enough to allow fuel to flow from the fuel tank 1401 to the burner 115 at least the consumption rate of the fuel in the burner 115. However, it may be small enough so as to reduce the temperature of any flame that enters the passageway restriction device from the burner 115 to an amount that causes the flame to extinguish by the time it leaves the other end of the passageway restriction device 1407. To accomplish this, the passageway restriction device 1407 may be made of a heat-sinking material, such as copper, aluminum or brass. The passageway restriction device 1407 may also have a length that is sufficient to provide the needed amount of cooling in view of the size of the interior channel 1409. For example, an interior channel diameter of approximately 1/16 inch may require a length of at least one inch to reliably extinguish any flame that attempts to pass through the passageway restriction device 1407.

The level of the surface 403 of the liquid fuel 401 in the burner 115 may eventually rise to the level of the surface 1403 of the liquid fuel 1405 in the fuel tank 1401. To insure that the level of the surface 403 of the liquid fuel 401 in the burner 115 does not rise above or get too close to the height of the burner 115, the top of the fuel tank 1401 may be positioned so as to be below the top of the burner 115, as illustrated in FIG. 14. Similarly, to insure that all of the fuel in the fuel tank 1401 may be delivered by gravity to the burner 115, the bottom of the fuel tank 1401 may be positioned above the bottom of the burner 115, as also illustrated in FIG. 14. The overall height of the fuel tank 1401 may be less than the overall height of the burner 115 so as to facilitate meeting these criteria, as also illustrated in FIG. 14.

With the design illustrated in FIG. 14, fuel may be safely added to the fuel tank 1401 through the fuel inlet 117 while the liquid fuel 401 in the burner 115 is burning.

The fuel tank 1401 may be mounted underneath the floor 103 of the firebox 101 on a sliding track. This may allow the fuel tank 1401 to be slid to the rear of the fireplace when it is not being filled with fluid, thereby positioning the fuel cap 119 and the fuel inlet 117 behind the front panel of the fireplace and out of sight. When fuel needs to be added, the fuel tank 1401 may be slid forward, thus moving the fuel cap 119 and the fuel inlet 117 in front of the fireplace, thus allowing liquid fuel to easily be pored into the fuel inlet 117. A removable cover, door or other means may be positioned over the front face of the fireplace, to hide the fuel cap 119, the fuel inlet 117, and the fuel tank 1401 after they are slid rearward. A flexible hose may be used to attach the fuel tank to the fuel channel 1411. The slide may use a detent in both the open and closed position to prevent movement while filling and while in operation. This detent may include notches in the slide rail to hold captive rollers or bearings.

Figure 15A:
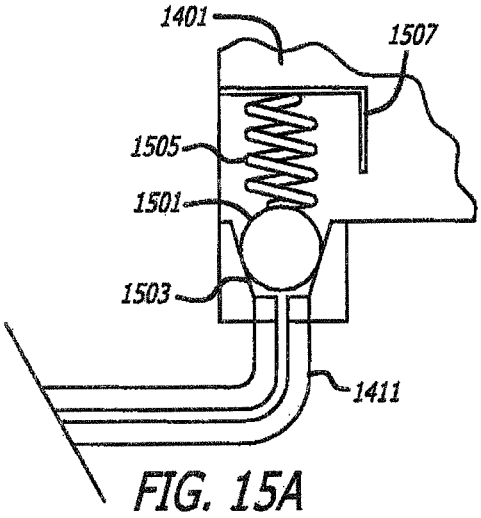
FIGS. 15(*a*) and (*b*) illustrate the fuel tank illustrated in FIG. 14 with a spring-loaded check valve.
Figure 15B:
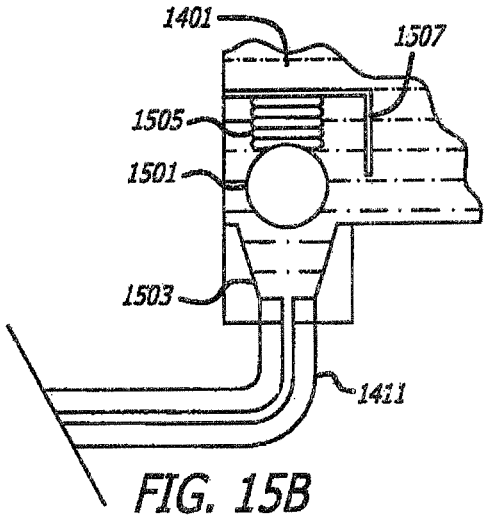

FIGS. 15(*a*) and (*b*) illustrate the fuel tank in FIG. 14 with a spring-loaded check valve. As shown in FIG. 15(*a*), the fuel tank 1401 may be empty. A ball 1501 may rest within the diameter of an output seat 1503, thus effectively blocking any flame that might try and flash back from a fuel channel 1411 into the fuel tank 1401. A spring 1505 may be included to maintain a strong seal between the ball 1501 and the output seat 1503 while the fuel tank 1401 is empty. The force applied by the spring 1505 in the position illustrated in FIG. 15(*a*) may help maintain the seal during vibration of the unit or gassing out of the burner as it is depleted by the fuel.

As illustrated in FIG. 15(*b*), the ball 1501 may rise when the fuel tank 1401 is filled with liquid fuel, thus opening the passageway between the fuel tank 1401 and the fuel channel 1411. The force exerted by the spring 1505 may be less than the difference between the specific gravity of the ball and the liquid feel, thus allowing the ball to float when fuel is added. The ball 1501 may be held captive in its raised position by a retaining bracket 1507.

Figure 16A:
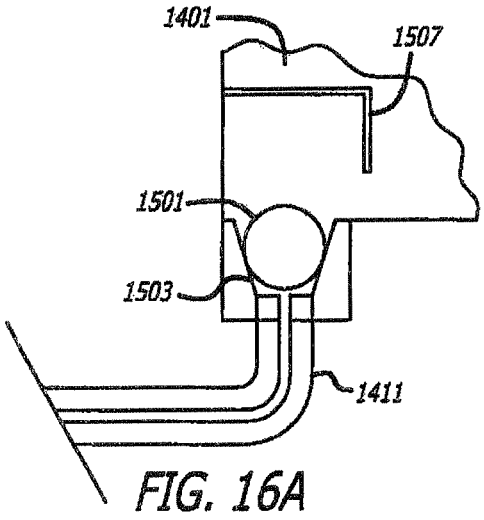
FIGS. 16(*a*) and (*b*) illustrate the fuel tank illustrated in FIG. 15 with a floating check valve.
Figure 16B:
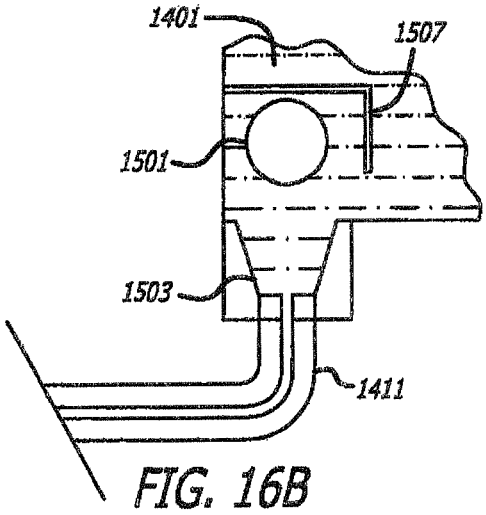

FIGS. 16(*a*) and (*b*) illustrate the Gel tank illustrated in FIGS. 15 (*a*) and (*b*) with a floating check valve. The configuration may be the same as illustrated in FIGS. 15(*a*) and (*b*), except that the spring 1505 may not be included.

Figure 17C:
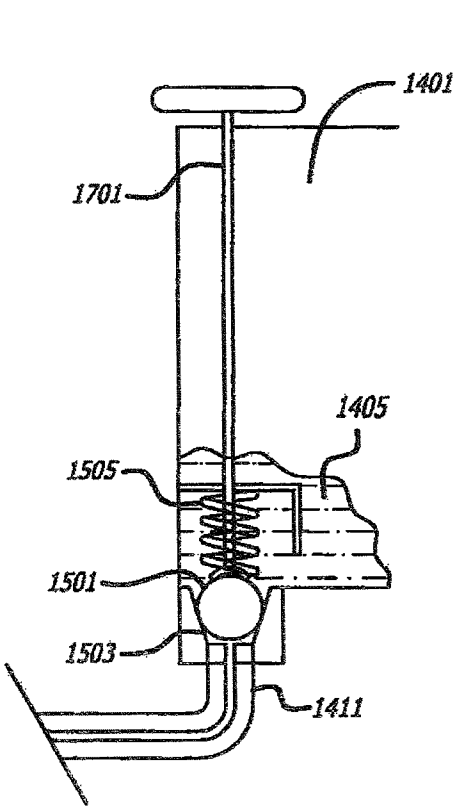
FIGS. 17(*a*)-(*c*) illustrate the fuel tank and spring-loaded check valve illustrated in FIGS. 15(*a*) and (*b*) with a fuel shut off valve.
Figure 17B:
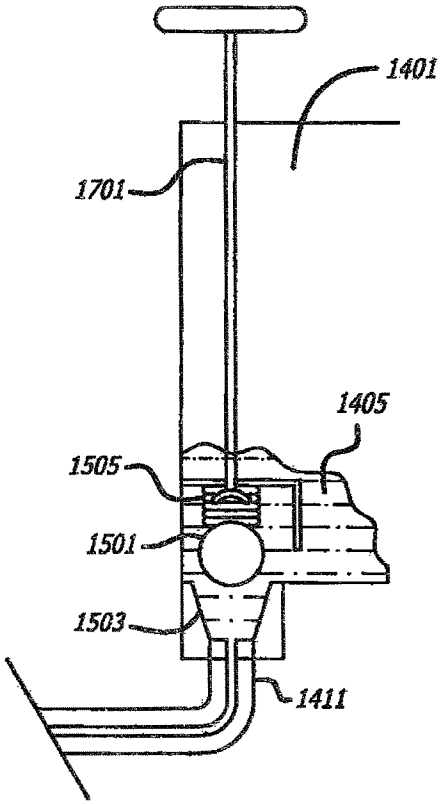
Figure 17A:
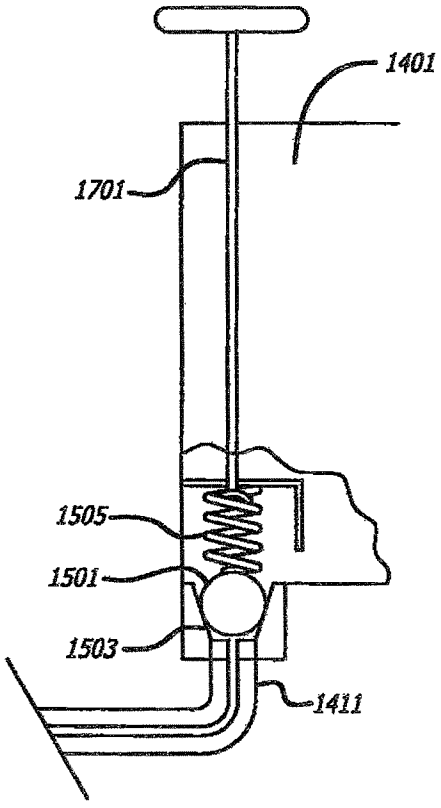

FIGS. 17(*a*)-(*c*) illustrate the fuel tank and spring-loaded check valve illustrated in FIGS. 15(*a*) and (*b*) with a fuel shut-off valve. As shown in FIGS. 17(*a*)-(*c*), a fuel shut-off rod 1701 may be added to the check valve configuration illustrated in FIGS. 15(*a*) and (*b*). When the fuel shut-off rod 1701 is in a raised position, as illustrated in FIGS. 17(*a*) and (*b*), the check valve may function as illustrated in FIGS. 15(*a*) and (*b*), as described above. When the fuel shut-off rod 1701 is in a lowered position, on the other hand, the check valve may be closed even when liquid fuel is within the fuel tank 1401, as illustrated in FIG. 17(*c*). Thus, the fuel shut-off rod 1701 may shut off fuel flow to the burner 115, regardless of the level of fuel in the fuel tank 1401.

The shaft of the fuel shut-off rod 1701 may be threaded, so as to allow it to be rotated between its open and closed positions. In addition or instead, a snap-lock mechanism may be provided that allows the fuel shut-off rod 1701 to be raised and snapped into an open position and/or lowered and snapped into a closed position. A solenoid or other type of automated means may be used in addition or instead to open and close the fuel path from the fuel tank 1401 to the fuel channel 1411.

Although having thus far been illustrated as having a rectangular cross section, the burner that is used in the fireplace may have other types of cross sections and shapes. For example, the burner may be oval.

Figure 18:
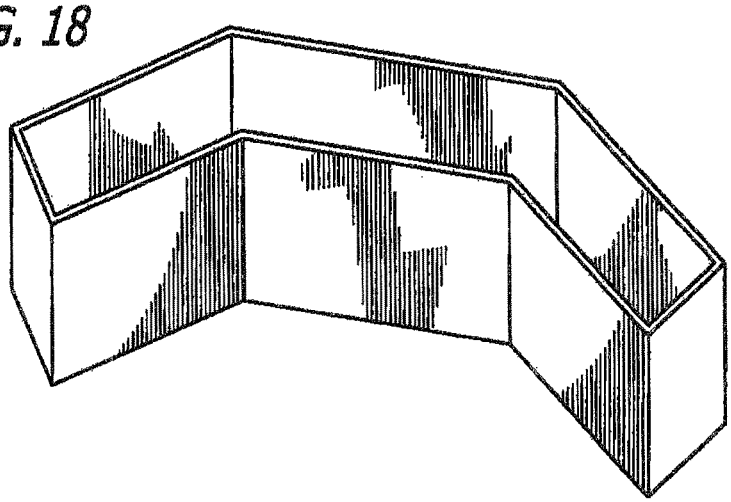
FIG. 18 illustrates an non-linear burner with a single channel.

The burner also need not be linear. FIG. 18 illustrates an non-linear burner with a single channel. This configuration may be used to give the flame more of a three-dimensional look.

Figure 19:
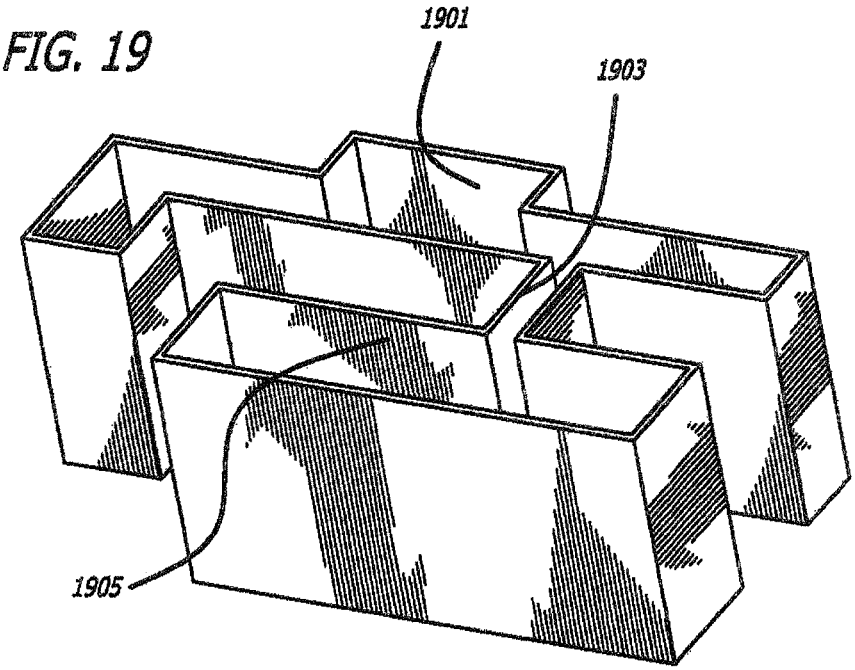
FIG. 19 illustrates a multiple channel burner.

FIG. 19 illustrates a multiple-channel burner. This configuration provides two rows of flames, with variation between the width and position of each row. Such a configuration may again be advantageously used to provide a more realistic looking flame. When multiple channel burners are used, burning channel areas may be joined by a narrow fuel carry-over section. For example, a burning channel area 1901 may be connected by a fuel carry-over section 1903 to a burning channel area 1905, thus allowing liquid fuel to freely flow between the burning channel areas. The fuel carry-over section 1903 may have a very small burn area and may be covered with a mesh to prevent flames from contacting logs that may be positioned above. The fuel carry-over section 1903 may instead have a cover with small holes that insure combustion within the burner, but prevent flames from rising high above the fuel carry-over section 1903. Other methods to prevent or minimize high flames above a fuel carry-over section may be employed in addition or instead.

Figure 20:
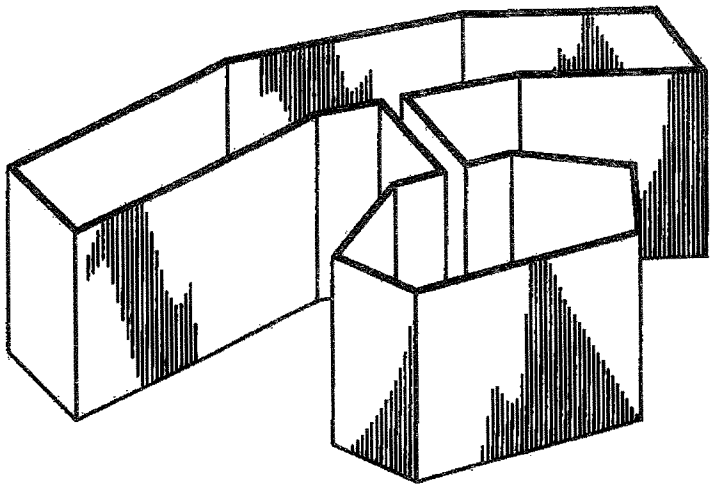
FIG. 20 illustrates another multiple channel burner configuration.

FIG. 20 illustrates another multiple channel burner configuration.

Figure 21:
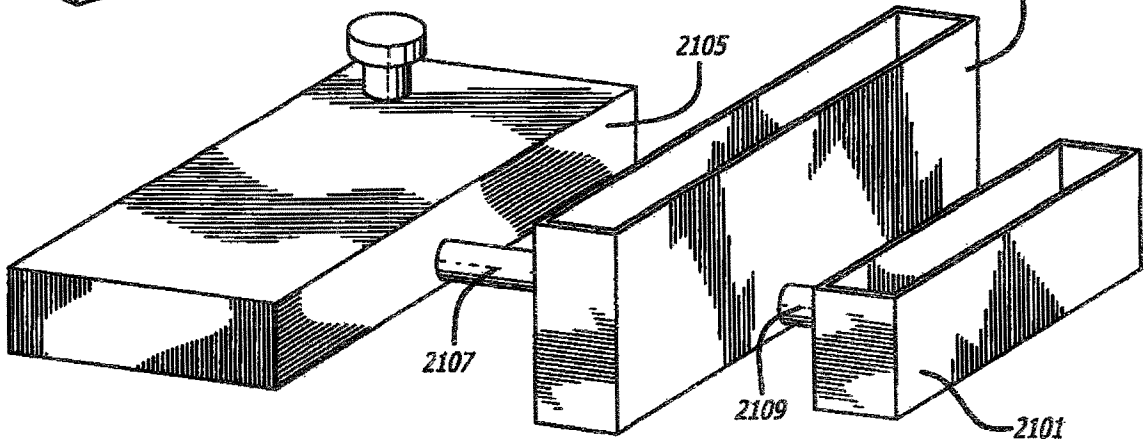
FIG. 21 illustrates a multiple channel burner coupled to a fuel tank.

FIG. 21 illustrates a multiple channel burner coupled to a fuel tank. As shown in FIG. 21, a first burner 2101 may receive a supply of liquid fuel from a fuel tank 2105 through a first fuel channel 2107. A second burner may receive liquid fuel from the first burner through a second fuel channel 2109. The second fuel channel 2109 may be used in lieu of a carry over section, such as the carry over section 1903 shown in FIG. 19.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

For example, liquid fuel other than ethanol may be used, such as kerosene or clean burning organic fuels. Also, the fireplace need not be sealed and/or directly vented. Instead, it may be unsealed, vent-free, and/or may have other vents.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. An apparatus, comprising:

a firebox having a substantially transparent front through which a flame within the firebox may be viewed; and a burner configured to hold a free-flowing liquid fuel to cause the free-flowing liquid fuel to boil and to cause the boiling fuel to burn and produce a flame, wherein the burner is positioned so as to cause the flame from the burning fuel to appear within the firebox and wherein the burner has a bottom and a plurality of adjoining sides, the plurality of adjoining sides defining an upper perimeter having a width and a height, where the ratio between the surface area defined by the upper perimeter and the length defined by the upper perimeter is 6.5:1 to 9.5:1 and wherein the height of the burner is at least 3.2 times its width.

2. The apparatus of claim 1 wherein the burner is configured to cause the bottom of the flame to be substantially above the surface of the liquid fuel.

3. The apparatus of claim 2 wherein the burner is configured to cause the liquid fuel to begin burning at a height that is approximately at the level of the upper perimeter.

4. The apparatus of claim 1 wherein the burner is configured to burn ethanol.

5. The apparatus of claim 1 further comprising an igniter that has a user-operated igniter control that may be operated by a user from outside of the firebox that, upon operation, causes liquid fuel within the burner to be ignited.

6. The apparatus of claim 5 wherein the igniter includes a metallic ignition rod positioned within the burner so as to form a spark gap between the ignition rod and a wall of the burner.

7. The apparatus of claim 6 wherein the ignition rod is angled with respect to the wall of the burner such that the top of the ignition rod is further away from the wall of the burner than the bottom of the ignition rod.

8. The apparatus of claim 1 further comprising an extinguisher that has a user-operated extinguisher control that may be operated by a user from outside of the firebox that, upon operation, causes the flame to be extinguished.

9. The apparatus of claim 8 wherein the extinguisher includes a lid sized and oriented to cover the burner upon operation of the user-operated extinguisher control.

10. The apparatus of claim 9 wherein the extinguisher includes mechanical linkage between the user-operated extinguisher control and the lid.

11. The apparatus of claim 9 wherein the lid has an open position at which the lid is recessed below the upper perimeter of the burner.

12. The apparatus of claim 1 further comprising a liquid fuel inlet located outside of the firebox, and a fuel channel between the liquid fuel inlet and the burner.

13. The apparatus of claim 12 further comprising a fuel tank, wherein the fuel inlet is configured to channel liquid fuel poured into the fuel inlet into the fuel tank, and wherein the fuel channel is between the fuel tank and the burner.

14. The apparatus of claim 13 wherein the fuel tank is positioned with respect to the burner so as to cause the upper perimeter of the burner to be higher than the highest level of liquid fuel that can be poured into the fuel tank through the fuel inlet.

15. The apparatus of claim 14 wherein the fuel tank is positioned beneath the firebox.

16. The apparatus of claim 15 wherein at least portions of the burner are positioned beneath the firebox.

17. The apparatus of claim 13 further comprising a passageway restriction device positioned within the fuel channel and configured to reduce the size of the channel at the location of the passageway restriction device, but not to completely block the flow of fuel through the passageway restriction device.

18. The apparatus of claim 17 wherein the passageway restriction device is configured so as to prevent a flame from flashing back from the burner into the fuel tank.

19. The apparatus of claim 18 wherein the passageway restriction device has an inlet and an outlet and is configured to cool a flame that enters the inlet while it travels to the outlet by a sufficient amount that the flame is extinguished by the time it reaches the outlet.

20. The apparatus of claim 13 further comprising a check valve configured to prevent any flame in the fuel channel from entering the fuel tank after the fuel in the tank is depleted.

21. The apparatus of claim 1 wherein the firebox is a sealed firebox having a substantially air-sealed, transparent, front through which a flame within the firebox may be viewed.

22. The apparatus of claim 1 wherein the firebox is vented.

23. The apparatus of claim 1 wherein the firebox is vent-free.

24. The apparatus of claim 1 further comprising an igniter that has a user-operated igniter control that may be operated by a user from outside of the firebox that, upon operation, causes liquid fuel within the burner to be ignited.

25. The apparatus of claim 1 further comprising an extinguisher that has a user-operated extinguisher control that may be operated by a user from outside of the firebox that, upon operation, causes the flame to be extinguished.

26. The apparatus of claim 25 wherein the extinguisher includes a lid sized and oriented to cover the burner upon operation of the user-operated extinguisher control.

27. The apparatus of claim 26 wherein the extinguisher includes mechanical linkage between the user-operated extinguisher control and the lid.

28. The apparatus of claim 26 the lid has an open position at which the lid is recessed below the upper perimeter of the burner.

29. The apparatus of claim 1 wherein the burner has a rectangular cross section.

30. The apparatus of claim 22 wherein the burner has a rectangular cross section.

31. A sealed, vented firebox having a substantially air-sealed, transparent, front through which a flame within the firebox may be viewed; and a burner configured to hold and burn a free-flowing liquid fuel and positioned so as to cause a flame from the burning fuel to appear within the firebox and an igniter that has a user-operated igniter control that may be operated by a user from outside of the firebox that, upon operation, causes liquid fuel within the burner to be ignited, wherein the igniter includes a float configured to float on the surface of liquid fuel within the burner and a sparking device attached to the float and positioned in sufficient proximity to the surface of the liquid fuel so as to ignite the surface of the liquid fuel.

32. An apparatus, comprising:

a firebox;

a burner made of steel, the burner configured to hold a liquid fuel and cause the liquid fuel to boil to produce a flame, the burner having a bottom and a plurality of adjoining sides, the plurality of adjoining sides defining an upper perimeter having a width and a height, where the ratio between the surface area defined by the upper perimeter and the length defined by the upper perimeter is 6.5:1 to 9.5:1 and wherein the height of the burner is at last 3.2 times its width;

an igniter that has a user-operated igniter control that may be operated by a user from outside of the firebox that, upon operation, causes liquid ethanol within the burner to be ignited; and an extinguisher that has a user-operated extinguisher control that may be operated by a user from outside of the firebox that, upon operation, causes the flame to be extinguished.

33. The apparatus of claim 32 wherein the burner has a rectangular cross section.

* * * * *